US010240344B2

(12) United States Patent
Reinhart et al.

(10) Patent No.: US 10,240,344 B2
(45) Date of Patent: Mar. 26, 2019

(54) METAL ROOF ABOVE SHEATHING VENTILATION SYSTEM

(71) Applicant: ATAS International, Inc., Allentown, PA (US)

(72) Inventors: Patrick James Reinhart, Bethlehem, PA (US); James Peter Bus, Orefield, PA (US); James Elmer Bush, Walnutport, PA (US); David Allen Smith, Walnutport, PA (US)

(73) Assignee: ATAS International, Inc., Allentown, PA (US)

( * ) Notice: Subject to any disclaimer, the term of this patent is extended or adjusted under 35 U.S.C. 154(b) by 119 days.

(21) Appl. No.: 15/450,822

(22) Filed: Mar. 6, 2017

(65) Prior Publication Data

US 2017/0254089 A1 Sep. 7, 2017

Related U.S. Application Data

(60) Provisional application No. 62/303,722, filed on Mar. 4, 2016.

(51) Int. Cl.

| | |
|---|---|
| ***E04D 13/17*** | (2006.01) |
| ***E04D 3/16*** | (2006.01) |
| ***E04D 3/36*** | (2006.01) |
| ***E04D 1/34*** | (2006.01) |

(52) U.S. Cl.

CPC ..... *E04D 13/17* (2013.01); *E04D 1/34* (2013.01); *E04D 3/16* (2013.01); *E04D 3/36* (2013.01)

(58) Field of Classification Search

CPC .... E04D 1/34; E04D 3/16; E04D 3/36; E04D 13/17; F16B 43/00

USPC ..... 411/531, 546

See application file for complete search history.

(56) References Cited

U.S. PATENT DOCUMENTS

| | | | | |
|---|---|---|---|---|
| 4,780,039 A * | 10/1988 | Hartman | E04D 3/3603 | 411/369 |
| 4,890,968 A * | 1/1990 | Beach | B25B 23/04 | 405/259.1 |
| 4,959,938 A * | 10/1990 | De Caro | E04D 3/3603 | 411/399 |
| 5,407,313 A * | 4/1995 | Bruins | E04D 5/143 | 411/369 |
| 5,934,855 A * | 8/1999 | Osterle | E04D 3/3603 | 405/302.1 |
| 6,250,034 B1 * | 6/2001 | Hulsey | E04D 3/3603 | 411/545 |

(Continued)

*Primary Examiner* — Roberta S Delisle
(74) *Attorney, Agent, or Firm* — Design IP

(57) ABSTRACT

A spacer designed to be inserted between the roofing panel clip and the sheathing is provided. The spacer has a configuration of openings and slots on the spacer to allow it to be used with a wide variety of panel clips. The opening for the fastener, the outer rim, and the walls of the spacer are designed to seal against the sheathing and provide tiers of protection to prevent water from contacting the fasteners. The spacers are designed to have lips, grooves, and recessed areas that coincide with the walls to accommodate stacking to allow for different channel heights without having to stock multiple spacer sizes. Also, the preferred embodiment of the spacer is rounded to prevent water from collecting along the edges of the spacer and instead flow down the slope of the roof. Finally, the spacer is specifically designed to have one spacer per panel clip.

10 Claims, 7 Drawing Sheets

(56) References Cited

U.S. PATENT DOCUMENTS

| | | | | |
|---|---|---|---|---|
| 6,282,857 | B1 * | 9/2001 | Rubenacker | E04D 5/145 411/531 |
| 6,565,303 | B1 * | 5/2003 | Riccitelli | E04D 3/3603 411/368 |
| 6,722,095 | B2 * | 4/2004 | Kobetsky | E04D 5/14 411/462 |
| 9,719,551 | B2 * | 8/2017 | Gere | E04D 5/145 |
| D809,681 | S * | 2/2018 | Reinhart | D25/199 |

* cited by examiner

METAL ROOF ABOVE SHEATHING VENTILATION SYSTEM

FIELD OF THE INVENTION

The present invention relates generally to roof ventilation systems, and more particularly, to a ventilated roofing system and method of construction assembled upon a roof structure which enables a flow of air between parallel roofing layers.

BACKGROUND

Improper building techniques are often the underlying culprit behind high energy costs, structural damage, and even health problems for the building inhabitants. Many of these problems are the direct result of improper ventilation. In the hot summer, direct sunlight overheats the roof, and creates a furnace effect in the attic. The air in the house, especially on the second floor if present, becomes unbearable. Excessive energy consumption from fans and air conditioning drives up electric bills. In the winter, condensation of humid air in the attic can lead to rotting of structural wood, deterioration of insulation, and result in mold and mildew leading to health problems. Finally, a lack of proper roof ventilation results in rapid aging of the roof, which may lead to leaks and home damage.

Various attempts have been made to address these problems. These attempts can be seen by example in several U.S. Patents. U.S. Pat. No. 3,797,180, issued in the name of Grange, discloses a ventilated roof construction system having a continuous corrugated baffle positioned between parallel roofing members. The baffle is provided to allow air flow from the fascia to the ridge to prevent the formation of ice dams.

U.S. Pat. No. 4,937,990, issued in the name of Paquette, discloses a ventilation system for roofs comprising an impermeable sheet having a series of openings on its surface and a series of roofing supports to provide a means to dry roofing insulation when there is a break in the vapor barrier protecting the insulation.

U.S. Pat. No. 6,780,099, issued in the name of Harper, discloses a roof ventilation system comprising a plurality of roof panels having an internal triangular shaped baffling for facilitating the flow of air from lower edge portions of the roof structure to the upper ridge portion.

U.S. Pat. No. 8,281,522, issued in the name of Hawryshko, discloses a roof ventilation system comprising a first sheathing layer and a second sheathing layer divided by a plurality of venting channels that are trapezoidal or angular in shape and each side panels of the vented channels have a plurality of vent openings to facilitate air flow.

Other solutions include ridge cap ventilators and roof construction, as can be seen by example in U.S. Pat. No. 5,022,314, issued in the name of Waggoner, which describes a roof ventilation apparatus and ventilation spacers for placement between fascia and roof sheathing, as can be seen by example in U.S. Pat. No. 5,361,551, which describes a ventilation spacer for roof construction.

While these devices may accomplish their specific intended purpose, each suffers from one or more disadvantages or deficiencies with respect to design, function, or effectiveness and none address the need for a solution of promoting appropriate ventilation utilizing metal roof panels. Accordingly, there is a need for a means by which roofing can be provided with complete and thorough ventilation in an effort to combat the above-mentioned problems.

The development of the present invention substantially departs from the conventional solutions and in doing so fulfills this need.

SUMMARY OF THE INVENTION

In view of the foregoing background, a spacer designed to be inserted between a roofing panel clip and the sheathing is provided for the purpose of creating a ventilation channel between the sheathing and the roof. The spacer includes a rigid body having a first end, a second end opposite the first end, a top surface extending between the first end and the second end, and a bottom surface extending between the first end and the second end and opposite the top surface, wherein the first and second ends define an outer perimeter around the rigid body that is rounded at each of the first and second ends.

The spacer also includes an outer wall extending downwardly from the bottom surface along the outer perimeter to an outer wall edge and an interior wall extending downwardly from the bottom surface to an inner wall edge and spaced inwardly from the outer wall. The outer wall and inner wall each have an exterior surface and an interior surface, with the outer wall edge and inner wall edge extending between their respective exterior and interior surfaces. In one embodiment, the inner wall edge and outer wall edge are coplanar.

The spacer further includes a primary fastener opening in the rigid body located between the first end and the second end, with the primary fastener opening extending from the top surface to the bottom surface and defining a primary fastener ridge. The primary fastener opening is sized and shaped to receive a roofing panel fastener.

The spacer has a configuration of openings and slots on the spacer to allow it to be used with a wide variety of panel clips. The opening for the fastener, the outer rim, and the walls of the spacer are designed to seal against the sheathing and provide tiers of protection to prevent water from contacting the fasteners. The spacers are designed to have lips, grooves, and recessed areas that coincide with the walls to accommodate stacking to allow for different channel heights without having to stock multiple spacer sizes. Also, the preferred embodiment of the spacer is rounded to prevent water from collecting along the edges of the spacer and instead flow down the slope of the roof. Finally, the spacer is specifically designed to have one spacer per panel clip.

BRIEF DESCRIPTION OF THE DRAWINGS

For a more complete understanding of the present invention, reference is made to the following detailed description of embodiments considered in conjunction with the accompanying drawings, in which.

DETAILED DESCRIPTION OF THE PREFERRED EMBODIMENTS

Figure 1:
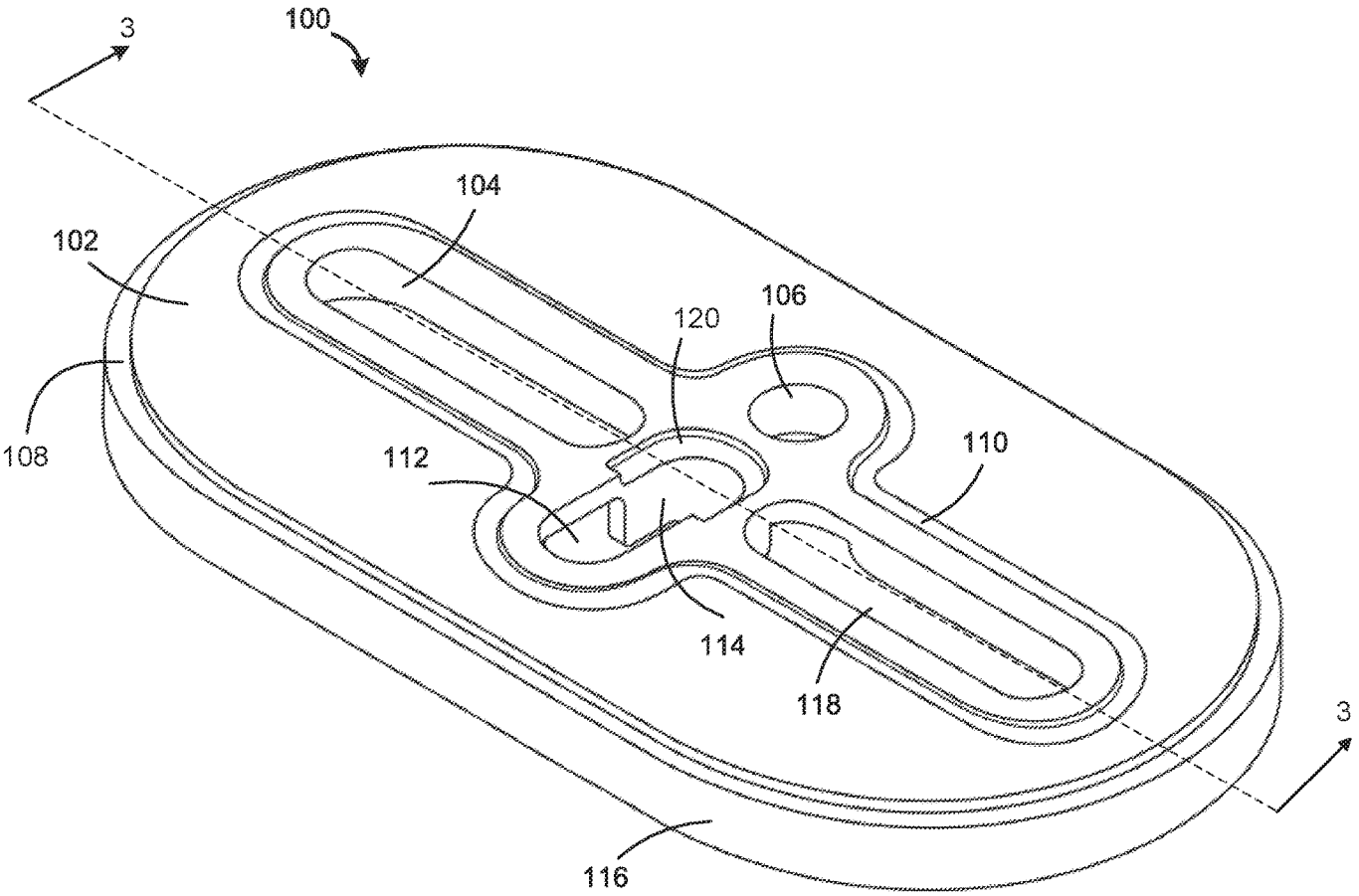
FIG. 1 is a top perspective view of a spacer shim constructed in accordance with an embodiment of the present invention.

The ensuing detailed description provides preferred exemplary embodiments only, and is not intended to limit the scope, applicability, or configuration of the herein disclosed inventions. Rather, the ensuing detailed description of the preferred exemplary embodiments will provide those skilled in the art with an enabling description for implementing the preferred exemplary embodiments in accordance with the herein disclosed invention. It should be understood that various changes may be made in the function and arrangement of elements without departing from the spirit and scope of the invention, as set forth in the appended claims.

To aid in describing the invention, directional terms may be used in the specification and claims to describe portions of the present invention (e.g., upper, lower, left, right, etc.). These directional definitions are merely intended to assist in describing and claiming the invention and are not intended to limit the invention in any way. In addition, reference numerals that are introduced in the specification in association with a drawing figure may be repeated in one or more subsequent figures without additional description in the specification, in order to provide context for other features.

Figure 5:
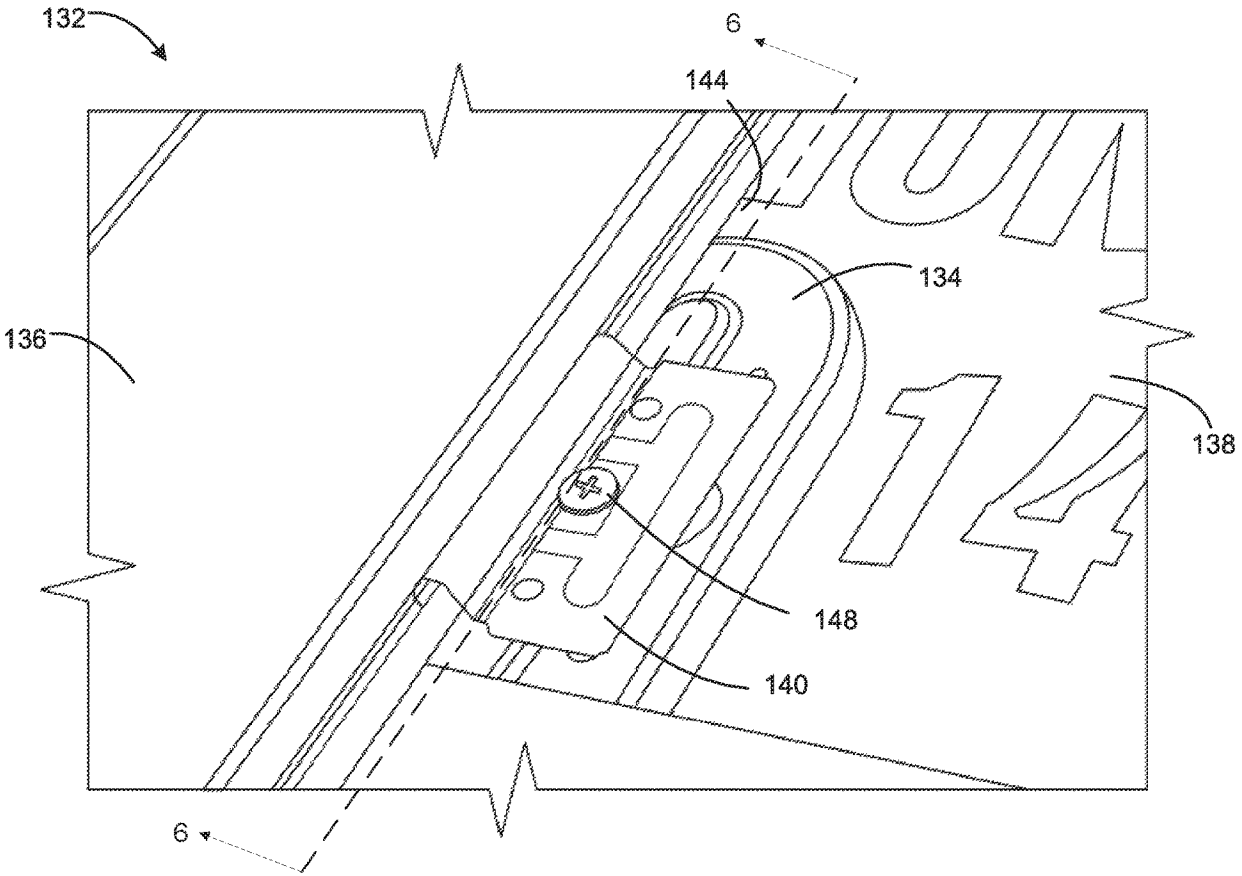
FIG. 5 is a perspective view of the spacer shim shown in FIG. 1 being used on roof sheathing and with a metal roof panel clip.

FIGS. 1 and 5 show, respectively, a roof above sheathing spacer shim ("spacer") 100 in accordance with an embodiment of the present invention, and the spacer 100 used in an exemplary manner with a roof panel 136, roof panel clip ("clip") 140, sheathing 138, and a fastener 148. As seen in FIG. 1, the spacer 100 is made from a single piece of material (e.g., composite, aluminum, steel, or other metal). The spacer 100 is designed to be inserted between the panel clip 140 and the sheathing 152 to create a ventilation channel 144 between the sheathing 152 and the roof.

More specifically, the spacer 100 of FIG. 1 has a top surface 102 and a bottom surface 124, with a configuration of openings and slots extending between the top and bottom surfaces 102, 124 to allow the spacer 100 to be used with a wide variety of panel clips 140. Since the spacer 100 is specifically designed to have one spacer per panel clip 140, the fastener 148 is preferably going to utilize the primary fastener opening 112. The centrically aligned primary fastener opening 112 is designed with the consideration that in use in conjunction with a fastener 148, the spacer 100 will not only be securely seated against the sheathing 138 but also will provide a fully supportive base for the entire dimensions of the panel clip 140.

However, the preferred embodiment of the invention is further designed to be used in conjunction with a variety of panel clips 140 that may or may not have a centrically located opening for a fastener 148. The spacer 100 has an elongated and typically but not limited as an oval shaped primary fastener opening 112 which extends depth-wise from the top surface 102 to the bottom surface 124 and centrally from the approximate middle of the spacer 100 to the side to allow for adjustment and proper seating of a clip 140 in conjunction with the clip's fastener opening. The preferred embodiment of the spacer 100 also has an alternate fastener opening 106 that is adjacent to the primary fastener opening 112 but on the opposite side to which the primary fastener opening 112 extends toward the outer wall 116 of the spacer 100. The alternate fastener opening 106 serves as an additional option to allow the spacer 100 to be used with a variety of panel clips 140 that may or may not have a centrically located placement for the fastener 148. Further, the spacer 100 has a minimum of two elongated slots 118 that are preferably but not limited to be located along the longitudinal central axis of the spacer 100. The slots 118, like the alternate fastener opening 106, serve as additional options to allow the spacer 100 to be used with a variety of clips 140 that may or may not have a centrically located placement for the fastener 148 or have additional fasteners 148 that can be used for additional attachment and proper seating of the clip 140.

The spacer 100, as shown in FIG. 1, preferably has unobstructed openings 106, 112 and slots 118 extending from the top surface 102 to the bottom surface 124. But it would be prudent to appreciate alternate embodiments of the invention that either possess openings and slots that are covered with a light plastic film or similar material or in the alternative, the openings 106, 112 and slots 118 are molded to completion wherein an amount of material from which the spacer is molded is left as a top surface of the openings 106, 112 and slots 118 to further promote the spacer's 100 design function of protecting the fastener 148.

Figure 2:
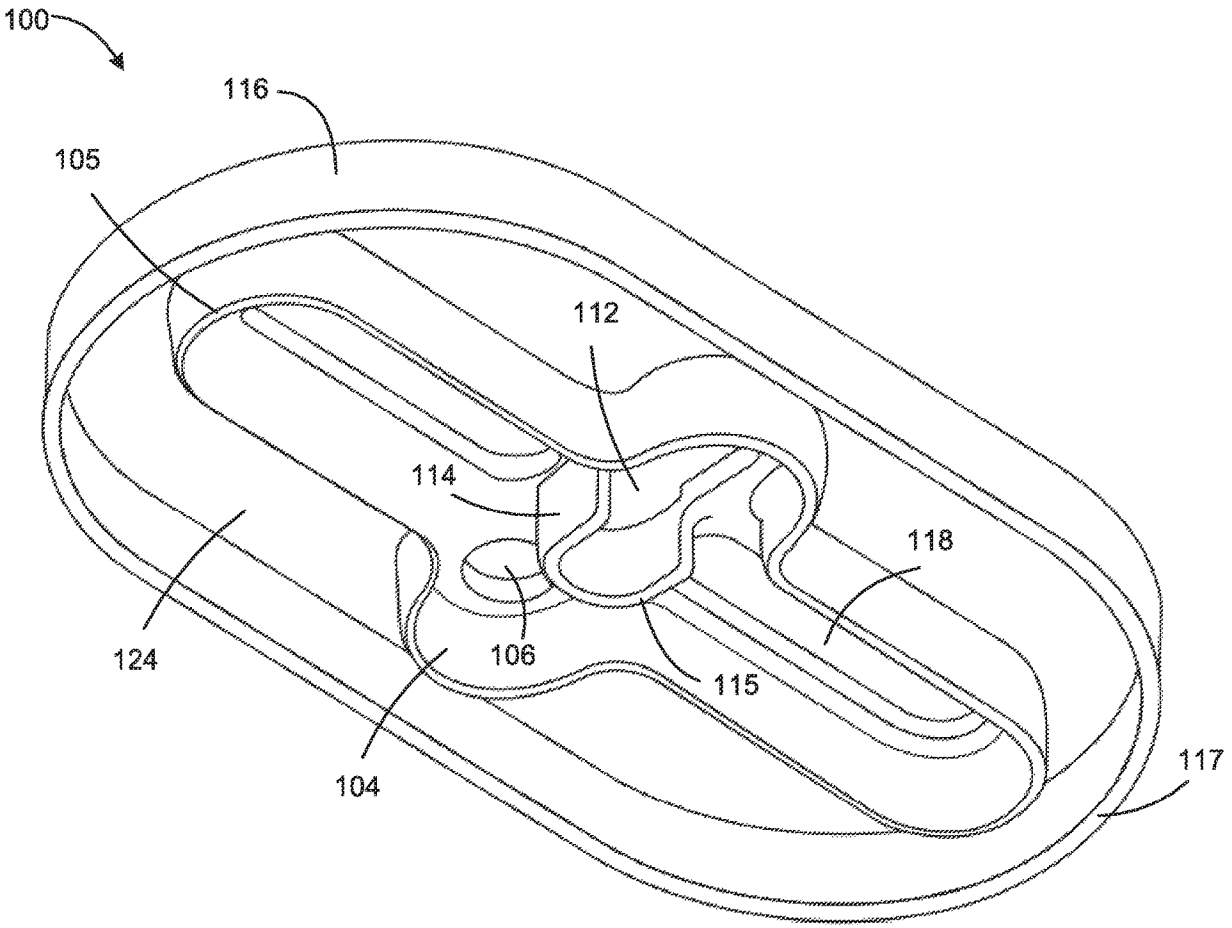
FIG. 2 is a bottom perspective view of the spacer shim shown in FIG. 1.
Figure 3:
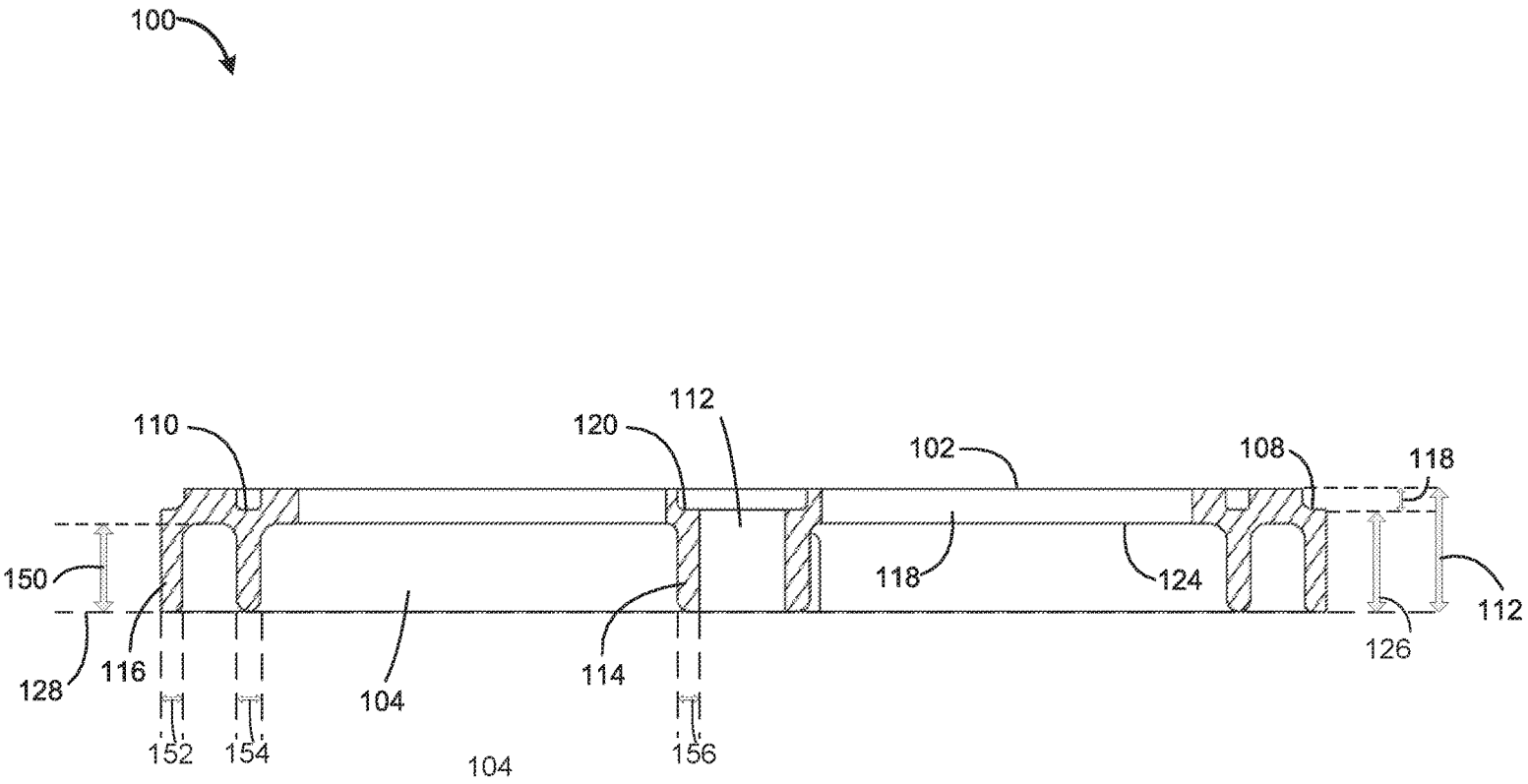
FIG. 3 is a cross-sectional view of the spacer shim shown in FIG. 1 taken along the line 3-3 and looking in the direction of the arrow.

As shown in FIGS. 2 and 3, the spacer 100 has an inner wall 114, central wall 104, and outer wall 116 designed to seal against the sheathing 138 that extend downward from the bottom surface 124 of the spacer 100 and for the purpose of but not limited to providing tiers of protection to prevent water from contacting the fasteners 148. The outer wall 116 is sized and shaped to be coextensive with the outer perimeter of the spacer 100, the central wall 104 is spaced inwardly from the outer wall 116 and is sized and shaped to surround the openings 106, 122 and slots 118 of the spacer 100, and the inner wall 114 is spaced inwardly from the central wall 104 and is positioned between the primary fastener opening 112 on one side, and the slots 118 and the alternate fastener opening 106 on the other side. The inner wall edge 115, the central wall edge 105, and the outer wall edge 117 are preferably coplanar with a bottom plane 128 to permit the spacer 100 to seat evenly on sheathing 138 and provide protection against water contacting the fastener(s) 148. Further, the preferred embodiment of the invention shows that the central walls 104 and the outer walls 116 are completely enclosed along their perimeters. In an alternative embodiment, the central walls 104 and the outer walls 116 may have one or more openings, preferably on the downward slope end of the spacer 100 to permit any water that may have entered the spacer to exit. Also, the preferred embodiment of the spacer 100 is rounded to prevent water from collecting along the edges of the spacer 100 and instead flow down the slope of the roof.

Figure 4:
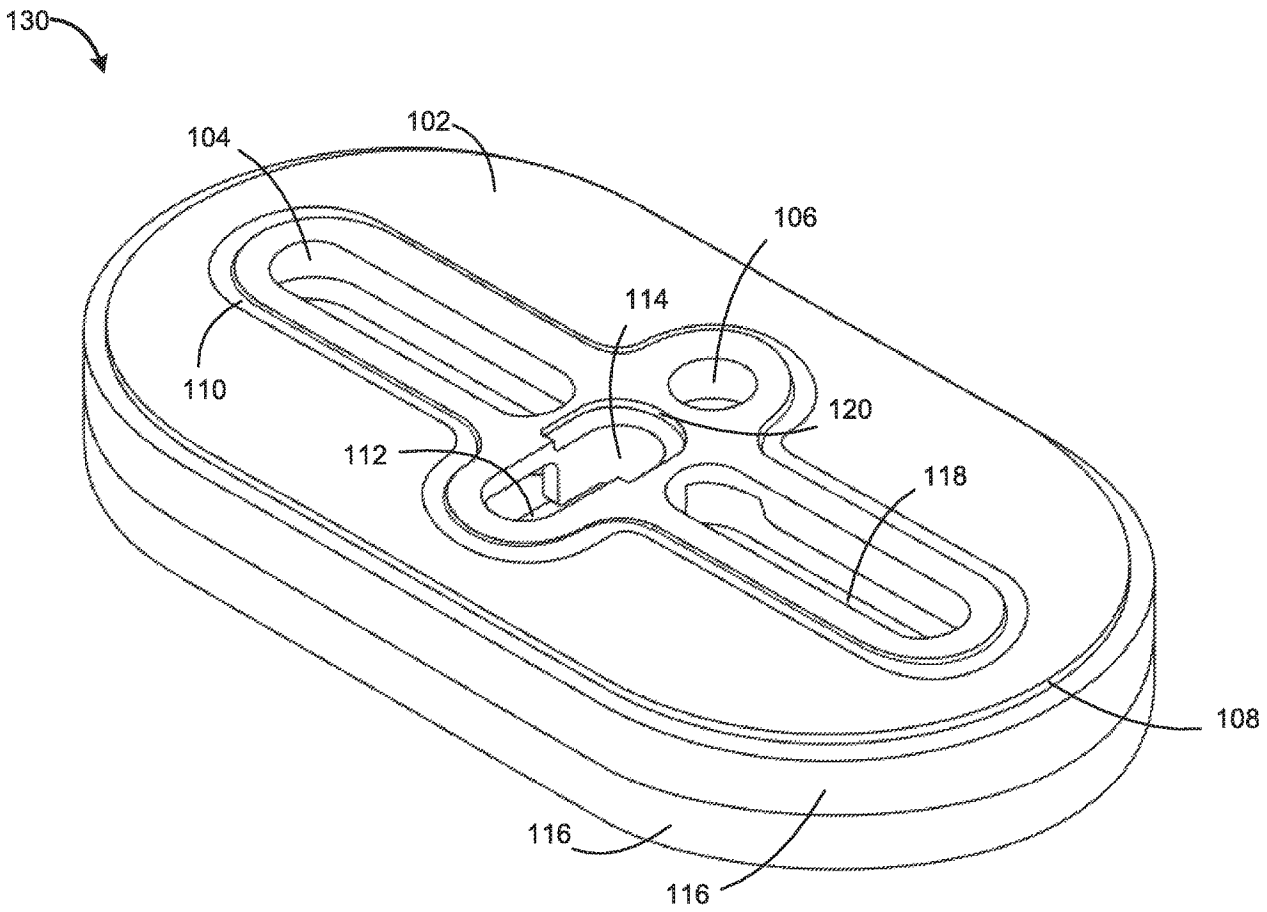
FIG. 4 is a top perspective view of two (2) spacer shims stacked together in accordance with an embodiment of the present invention.

The spacers 100 as shown in FIGS. 1 and 3, are designed to have an outer lip 108 that coincides with the outer wall 116 and an inner wall 114 and a central wall 114 that coincide with a recessed area 120 and a groove 110 respectively, to accommodate stacking (see FIG. 4) and to allow for different channel heights without having to stock multiple spacer 100 sizes. The preferred embodiment of the invention is approximately but not limited to being ⅜ (0.375) inches in height 122 and when two spacers 100 are stacked together (one on top the other as depicted in FIG. 4) the height of the combined spacers is approximately but not limited to ¾ (0.75) inches, which is optimal for above sheathing ventilation.

Referring to FIG. 3, in the preferred embodiment, the outer wall 116, central wall 104 and inner wall 114 all have a wall height 150 that is the distance measured from the bottom surface 124 to the bottom plane 128 of the outer wall edge 117, the central wall edge 115, and the inner wall edge 105. The outer wall 116 has an outer wall thickness 152 that is the distance measured between the exterior and interior surfaces of the outer wall 116, the central wall 104 has a central wall thickness 154 that is the distance measured between the exterior and interior surfaces of the central wall 104, and the inner wall 114 has an inner wall thickness 156 that is the distance measured between the exterior and interior surfaces of the inner wall 114. The wall height 150 of the outer, central, and inner walls 116, 104, 114 is significantly greater than the walls' respective thicknesses (i.e., outer, central, and inner wall thicknesses 152, 154, 156) to allow for ventilation between the outer, central, and inner walls 116, 104, 114. Further, in embodiments where the central and outer walls 104, 116 have one or more openings to allow water to drain from underneath the spacer 100, the high wall height 150 lessens the effects of surface tension between the bottom surface 124 and the roof sheathing, thereby further facilitating water drainage and ventilation. In a preferred embodiment, the outer, central, and inner walls 116, 104, 114 each have a height-to-thickness ratio of 2:1, and more preferably 4:1, to further the advantages discussed above while also ensuring the structural integrity of the spacer 100 and minimizing the amount of material used to make the spacer 100.

As shown in FIG. 3, the spacer 100 has a spacer height 122 and a wall height 150 that is less than the spacer height 122. The spacer 100 also has a thickness that is measured by the distance between the top surface 102 and the bottom surface 124. Alternatively, the thickness of the spacer 100 may also be measured by the difference between the spacer height 122 and the wall height 150. In a preferred embodiment, the spacer 100 has a height-to-thickness ratio of at least 4:1 (i.e., spacer height 122≥4 (spacer height 122−wall height 150)) to ensure that there is sufficient ventilation under the bottom surface 124 of the spacer 100.

Figure 6:
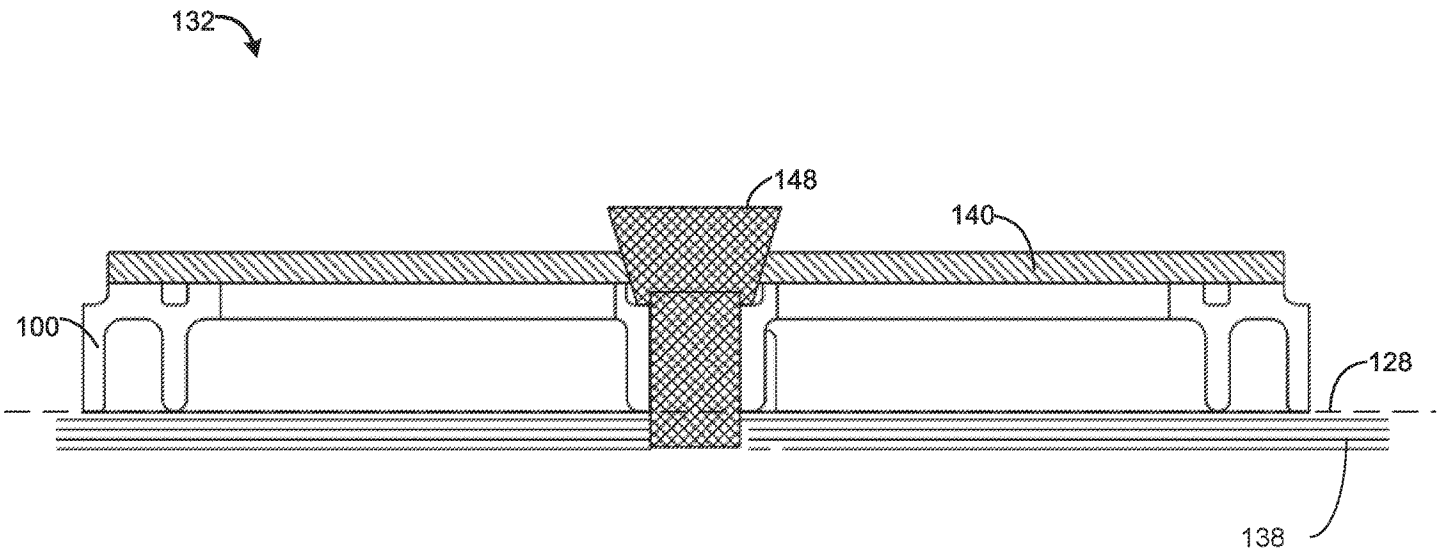
FIG. 6 is a cross-sectional view of the spacer shim shown in FIG. 5 taken along the line 6-6 and looking in the direction of the arrow.
Figure 7:
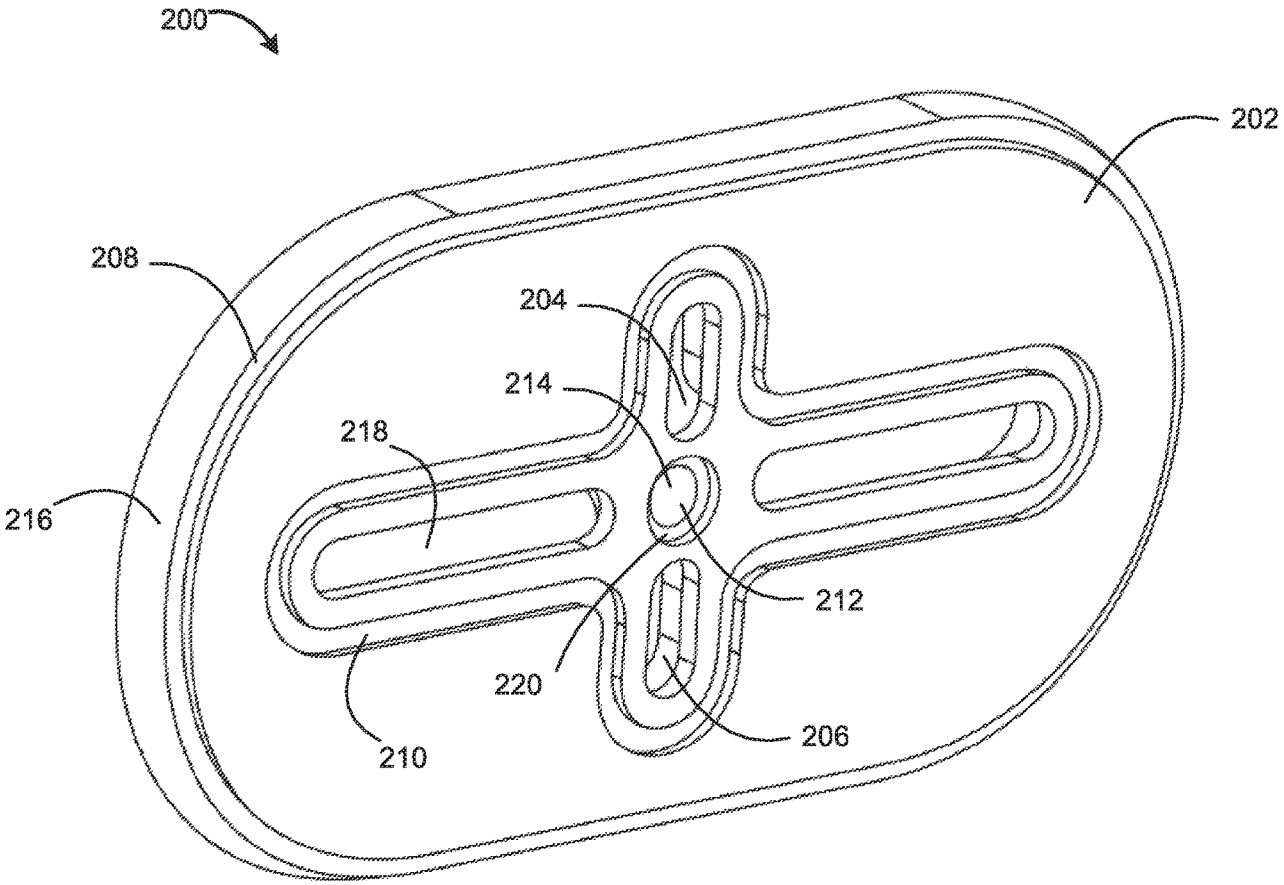
FIG. 7 is a top perspective view of a spacer shim in accordance with another embodiment of the present invention.

FIG. 6 shows a cross-sectional view of the preferred embodiment of the spacer 100 being used with a roofing panel clip 140, with the clip 140 having a centrically located opening for the fastener 148. FIG. 6 further shows the exemplary seating of the spacer 100 on the sheathing 138 and how the inner wall edge 105, the central wall edge 115, and the outer wall edge 117 are all coplanar (i.e., sharing the same bottom plane 128) and seat preferably evenly onto the sheathing 138, creating the tiers of protection from water contacting the fastener 148.

In the figures, elements that are similar to those of other embodiments of the present invention are represented by reference numerals increased by a value of 100. Such elements should be regarded as having the same function and features unless otherwise stated or depicted herein, and the discussion of such elements may therefore not be repeated for multiple embodiments.

Thus, embodiments of a spacer have been provided herein. In at least one embodiment, the inventive spacer may advantageously be functional in a wider range of operating conditions (e.g., roofing, wall, or other construction purpose) as compared to conventionally utilized spacers, thereby providing a spacer having improved functionality in a wider range of applications.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from essential scope thereof. Therefore, it is intended that the invention not be limited to the particular embodiment disclosed as the best mode contemplated for carrying out this invention, but that the invention will include all embodiments falling within the scope of the appended claims.

We claim:

1. A spacer comprising:

a rigid body having a first end, a second end opposite the first end, a top surface extending between the first end and the second end, and a bottom surface extending between the first end and the second end and opposite the top surface, the first end and the second end defining an outer perimeter around said rigid body that is rounded at each of the first and second ends;

an outer wall extending downwardly from the bottom surface along the outer perimeter to an outer wall edge, the outer wall including an outer wall exterior surface and an outer wall interior surface, the outer wall edge extending between the outer wall exterior surface and the outer wall interior surface;

an interior wall extending downwardly from the bottom surface to an inner wall edge and spaced inwardly from the outer wall, the inner wall including an inner wall exterior surface and an inner wall interior surface, the inner wall edge extending between the inner wall exterior surface and the inner wall interior surface; and a primary fastener opening in the rigid body located between the first end and the second end, the primary fastener opening extending from the top surface to the bottom surface and defining a primary fastener ridge, the primary fastener opening being sized and shaped to receive a roofing panel fastener;

wherein the inner wall edge and the outer wall edge are coplanar.

2. The spacer of claim 1, wherein the spacer is unitary and made from a single piece of material.

3. The spacer of claim 1, further comprising a first elongated slot located between the first end and the primary fastener opening, the first elongated slot extending from the top surface to the bottom surface and defining a first elongated slot ridge, the first elongated slot being sized and shaped to receive a roofing panel fastener.

4. The spacer of claim 3, further comprising a second elongated slot located between the second end and the primary fastener opening, the second elongated slot extending from the top surface to the bottom surface and defining a second elongated slot ridge, the second elongated slot being sized and shaped to receive a roofing panel fastener.

5. The spacer of claim 1, further comprising an alternate fastener opening in the rigid body located between the first end and the second end and adjacent to the primary fastener opening, the alternate fastener opening extending from the top surface to the bottom surface and defining an alternate fastener ridge.

6. The spacer of claim 1, wherein the outer wall is coextensive with the outer perimeter and the outer wall edge is parallel to the top surface.

7. The spacer of claim 6, further comprising an outer recess extending into the rigid body from the top surface to an outer recess floor, the outer recess being sized and shaped to receive the outer wall edge of a second spacer.

8. The spacer of claim 7, wherein the outer recess floor has a width that is equal to a width of the outer wall edge.

9. The spacer of claim 7, further comprising an inner recess extending into the rigid body from the top surface to an inner recess floor, the inner recess being sized and shaped to receive the inner wall.

10. The spacer of claim 1, wherein the outer wall has a height measured from the bottom surface to the outer wall edge, a thickness measured from the outer wall exterior surface to the outer wall interior surface, and a ratio of height to thickness that is at least 4:1.

* * * * *